United States Patent [19]

Chatigny

[11] 4,004,364

[45] Jan. 25, 1977

[54] ROTATABLY MOUNTED SEAR

[75] Inventor: Raymond E. Chatigny, Gardner, Mass.

[73] Assignee: Harrington & Richardson, Inc., Gardner, Mass.

[22] Filed: Jan. 20, 1975

[21] Appl. No.: 542,458

[52] U.S. Cl. ..... 42/69 A; 42/70 C

[51] Int. Cl.[2] ..... F41C 19/00; F41C 17/00

[58] Field of Search ..... 42/69 A, 69 R, 70 D, 42/16, 70 C

[56] References Cited

UNITED STATES PATENTS

| | | | |
|---|---|---|---|
| 223,662 | 1/1880 | Wetmore | 42/69 A |
| 2,062,079 | 11/1936 | Wiles | 42/69 A |
| 2,249,231 | 7/1941 | Smith | 42/69 A |
| 2,856,717 | 10/1958 | Parke | 42/69 A |
| 3,168,788 | 2/1965 | Coulter | 42/69 R |

*Primary Examiner*—Charles T. Jordan
*Attorney, Agent, or Firm*—Charles R. Fay

[57] ABSTRACT

In a firearm having a firing pin and means for propelling the same to firing position, a rotatably mounted sear, and a sear trip holding the sear in the path of the firing pin until the trigger is pressed, releasing the sear trip, and allowing the firing pin to move past the sear to firing position.

Also in combination with the sear trip, a safety mechanism having a position to inhibit releasing motion thereof.

5 Claims, 5 Drawing Figures

ROTATABLY MOUNTED SEAR

BACKGROUND OF THE INVENTION

In the design and manufacture of firearms it is always a consideration to obtain a smooth crisp trigger action, a long creep of the trigger is not desirable. In the past the sears and their interconnection with respect to the trigger, firing pin, etc., become worn after repeated usage and ordinarily such wear results in extending the trigger travel necessary to release the hammer or firing pin and otherwise defeating the smooth crisp action which is wanted.

The present invention has a two-fold object one of which is to improve the action and at the same time to provide for longer wear thereof increasing the life of the firearm in respect to the trigger, sear, etc.

SUMMARY OF THE INVENTION

In the present case the firing pin of the firearm disclosed to illustrate the invention is actuated by a bolt more or less in the usual manner to retract the spring-pressed firing pin to a position where it is held by its sear, the sear being releasable by the trigger to release the firing pin for ignition. In the present case there is provided a sear which as disclosed herein is cyindrical and has an end in the form of a truncated cone. It is vertically movable between two positions, one where the firing pin is held against firing until the trigger is pulled, and the other, a down position, represents the release of the firing pin to fire the cartridge in the breech. The entire sear is freely rotatable on its axis.

A sear release member or trip is provided to hold the sear in firing pin inhibiting position and this sear trip is provided with a tongue and groove connection with respect to the trigger whereby when the trigger is pulled and pivots on its trigger pin, the sear trip is pivoted a very short distance, releasing the sear, so that it can move down under influence or under impetus of the firing pin to fire the shell. A mechanical advantage is presented in this action wherein a short motion of the trigger results in a relatively greater motion of the sear trip providing an extremely crisp smooth action for the firearm.

In addition, a pivoted safety bar is provided under control of a manually actuatable lever which has two positions, one in which it is held in abutment with respect to said sear trip preventing it from moving to release the sear; or on the other hand it is manually movable to a position where it does not have contact with the sear trip which is thereby free to be moved from sear holding position by the trigger.

PREFERRED EMBODIMENT OF THE INVENTION

Figure 1:
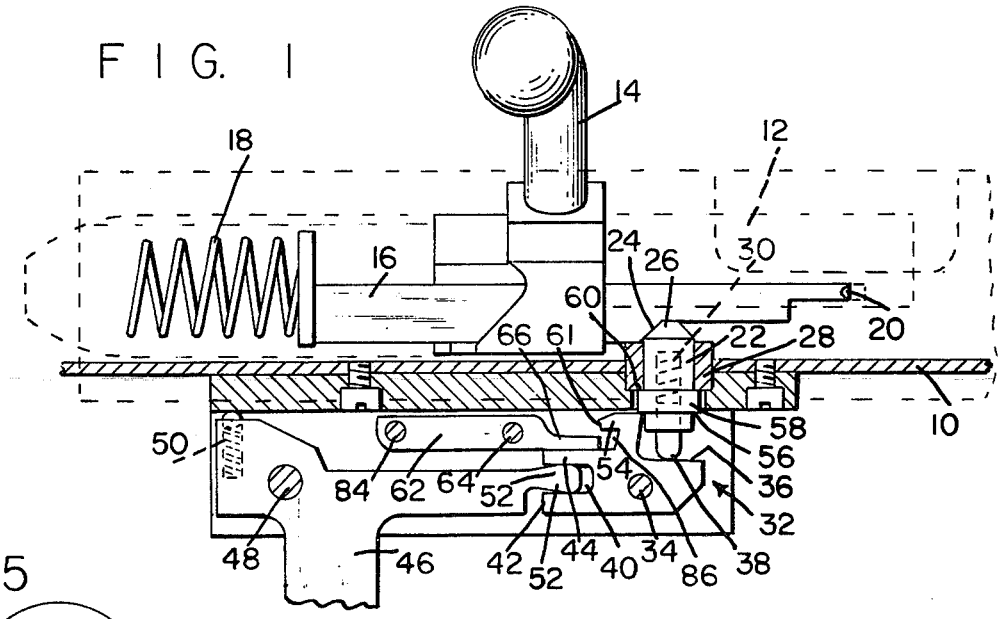
FIG. 1 is a view in side elevation of a receiver with parts broken away illustrating the invention, the firing pin being cocked and the safety in firing position.

A receiver 10 is shown which is more or less conventional and is provided with a substantially conventional sliding and rotating bolt 12 having a handle 14 for retracting the firing pin 16, the bolt being operated more or less in the usual manner by being raised to the FIG. 1 position, retracted, moved forwardly again, and down, as is well known to those skilled in the art. The firing pin has a spring 18 which constantly tends to move it forwardly, and a nose 20 for the ignition.

The firing pin is held in cocked position as shown in FIG. 1 by means of a novel sear 22. The firing pin has a shoulder 24 for engagement with the portion of the sear indicated at 26, this portion being of frusto-conical shape, the sear itself being cylindrical. The sear is rotatably mounted in a bushing 28 in the receiver and is provided with a spring 30 maintaining the same in its uppermost position. As will be described hereinafter, the sear 22 upon retreating downwardly from the FIG. 1 position, releases the shoulder 24 so that spring 18 may snap the firing pin to the firing position. Then the firing pin is retracted to cocked position by means of the bolt, and the sear rises to hold the firing pin once more.

There is a sear trip generally indicated at 32 pivotally mounted on a pin 34 and having a shoulder 36 against which bears a spring pressed member 38 engaged with spring 30 to maintain the sear 22 in the uppermost firing pin holding position. The sear trip 32 is provided at the opposite side of pivot 34 with a recess 40 formed by a pair of rearwardly projecting extensions 42 and 44.

The trigger 46 is mounted on trigger pin 48 and is provided with a spring 50 to maintain the same in the position shown in FIG. 1, being yieldable to allow the shooter to pull the trigger. The trigger is provided with a forward nose 52 which is permanently engaged in the notch 40 between the arms 42 and 44 of the sear trip.

The sear trip is provided with a relatively sharp sear nose at 54 which normally in cocked position of the firearm engages under an annular shoulder 56 facing downwardly and located on the sear surrounding the same. This shoulder may be formed by a portion of the sear having a greater diameter as is indicated at 58 and at the same time forms an upper shoulder 60 bearing against the bottom bushing 28 and maintaining the sear in the position shown in FIG. 1 with the sear trip nose 54 engaged under shoulder 56.

When the trigger is pressed, the sear trip moves in a counterclockwise direction releasing the sear nose 54 from the sear so that the firing pin spring 18 can move the firing pin forwardly depressing the sear out of its path. Of course when the firing pin 16 is retracted the spring 30 will urge the sear 22 back to its upper firing pin holding position.

It will be seen that the distance between trigger pin 48 and nose 52 is very much greater than the distance between pin 34 and trigger nose 54 so that a very short motion of trigger 46 produces a correspondingly greater motion at the point of the sear trip nose 54, and this results in an extremely crisp and smooth retraction of the sear trip nose at consequent firing of the gun.

Figure 5:
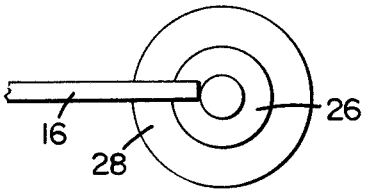
FIG. 5 is a detail view illustrating a modification of the relationship between the firing pin and the sear.

Now referring to FIG. 5, it will be seen that the firing pin shoulder at 24 may engage the frusto-conical portion of the rotary sear 22 slightly off center and thus it will be apparent that the action of firing the firearm will tend to rotate the entire sear so that each time the gun is fired the shoulder 24 will engage a different surface thereby increasing the life of the sear several times before the crispness of the action or any kind of jamming action or malfunction would be possible. At the same time the shoulder 24 of the firing pin 16 may impinge directly on a diametrical portion of the surface of the conical portion 26 and while the rotary action will not be as great, the mere action of firing the gun will tend to act on the sear 22 so that it will tend to turn in any event.

Figure 3:
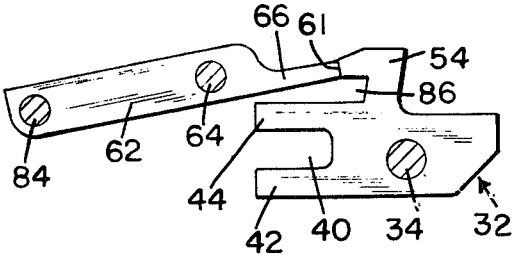
FIG. 3 is a detail view illustrating the safety mechanism in safe position.
Figure 4:
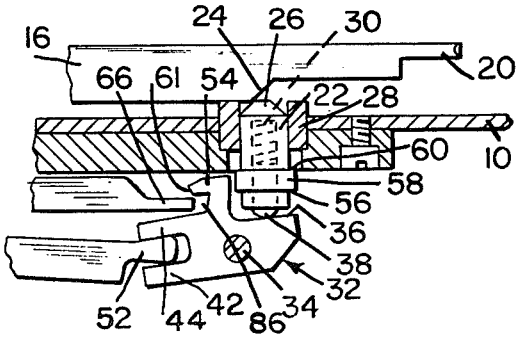
FIG. 4 is a detail view showing the sear released and the firing pin in firing position.

The sear trip is provided with a rearwardly facing nose 61 and a pivoted safety bar 62 pivoted at 64 to the receiver and is provided with a cooperating nose 66. Safety bar 62 may be pivoted in a counterclockwise direction as in FIG. 3 to engage the shoulder or nose 61 thereby preventing the sear trip from operating and forming a very effective safety for this firearm.

Figure 2:
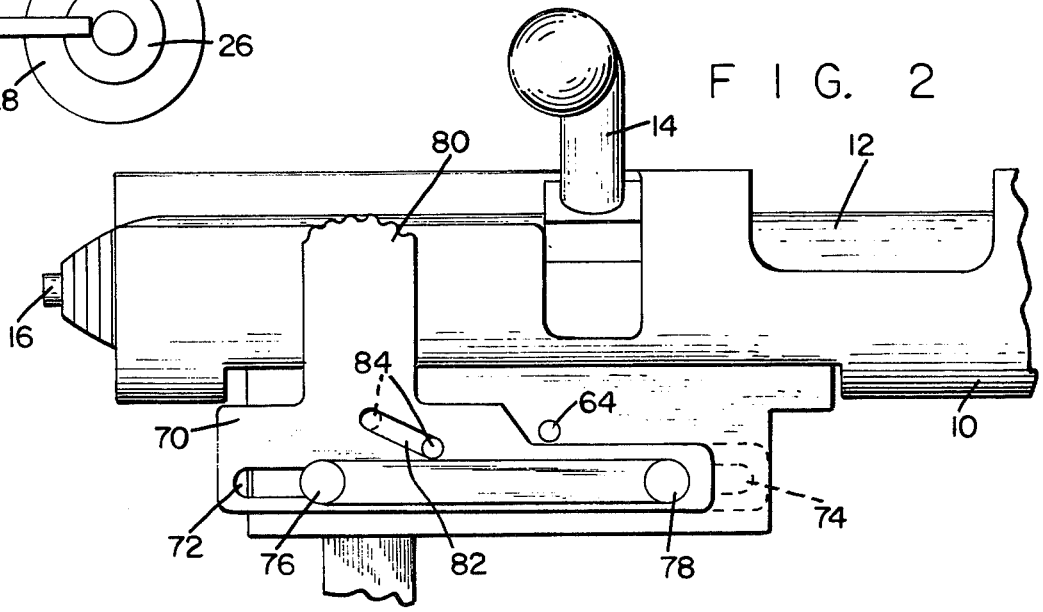
FIG. 2 is a similar view with part of the receiver removed in order to show the action and construction of the safety actuator.

The safety bar 62 is held in either the position shown in FIG. 1 or with nose 66 engaging nose 61 by means of the safety actuator 70, see FIG. 2. This safety actuator is provided with a pair of parallel aligned slots 72, 74 through which project fixed pins 76, 78 so that the actuator bar 70 is longitudinally movable under influence of manual member 80 in close association with respect to the receiver. There is an angular inclined slot 82 therein which receives the cam pin 84 on the safety bar 62 and thereby causes the safety bar to incline between the position shown in FIG. 1 and a position shown in FIG. 3 in which the nose 66 engages nose 61 and holds the firearm against firing. Alternatively, the actuator moves the safety bar in the opposite direction to lodge nose 66 in a recess 86 in the sear trip under its nose 61, to free the trip so that it can be actuated by the trigger to fire the gun.

I claim:

1. A firearm comprising a receiver, a firing pin therein, means moving the firing pin between the firing and the cocked position, and a sear temporarily holding the firing pin in the cocked position, said sear comprising a longitudinally movable rotatable member movable in general at right angles with respect to the firing pin and engaging the same, a movable sear trip holding the sear in the cocked position of the firing pin, a trigger, and interengaging means between the trigger and sear trip for releasing the sear allowing the firing pin to move to the firing position, spring means for yieldably holding the sear in the firing pin cocked position thereof, the firing pin depressing the sear along its line of motion when the sear trip is released from its sear holding position, and a bushing holding the sear in position on the receiver but allowing longitudinal motion thereof.

2. The firearm of claim 1 wherein said sear is cylindrical.

3. The firearm of claim 1 wherein the sear trip is pivoted and including a shoulder on the sear and a nose on the sear trip engaging under said shoulder and preventing the sear from dropping except when the trigger is pulled to move the sear trip nose out of the sear holding position.

4. A firearm comprising a receiver, a firing pin therein, means moving the firing pin between the firing and the cocked position, and a sear temporarily holding the firing pin in the cocked position, said sear comprising a longitudinally movable rotatable member movable in general at right angles with respect to the firing pin and engaging the same, a movable sear trip holding the sear in the cocked position of the firing pin, a trigger, and interengaging means between the trigger and sear trip for releasing the sear allowing the firing pin to move to the firing position, a pivoted safety bar, means on the safety bar for engagement with the sear trip to prevent the same from moving under action of the trigger, manually operated means for moving the safety bar between safety position and firing position, and a rearwardly projecting safety nose on the sear trip for engagement with an end portion of said pivoted safety bar, and a rearwardly facing notch in said sear trip to receive the end of the safety bar in the firing position thereof.

5. The firearm of claim 4 wherein the means for moving the safety bar comprises a longitudinally reciprocal member having an inclined slot therein and engaging a projecting pin on the safety bar at a remote point from the pivot point of the safety bar.

* * * * *